US005244093A

United States Patent [19]

Carmichael et al.

[11] Patent Number: 5,244,093

[45] Date of Patent: Sep. 14, 1993

[54] SLEEVE PACKAGE WITH SUPPORTING ENGAGEMENT

[75] Inventors: Gary H. Carmichael, Des Plaines; Harry I. Roccaforte, Chicago, both of Ill.

[73] Assignee: Kraft General Foods, Inc., Northfield, Ill.

[21] Appl. No.: 795,785

[22] Filed: Nov. 21, 1991

[51] Int. Cl.[5] ..... B65D 5/08; B65B 5/00

[52] U.S. Cl. ..... 206/499; 53/397; 53/469; 206/45.34; 229/109

[58] Field of Search ..... 206/45.14, 45.31, 45.34, 206/430, 431, 432, 445, 499, 526; 229/108, 109, 208; 53/397, 399, 467, 469, 472

[56] References Cited

U.S. PATENT DOCUMENTS

| | | | |
|---|---|---|---|
| 2,335,914 | 12/1943 | Buttery | 206/56 |
| 2,796,979 | 6/1957 | Buttery | 206/45.31 |
| 2,840,233 | 6/1958 | Grinspoon | 206/430 |
| 2,991,910 | 7/1961 | Coe | 221/305 |
| 3,029,935 | 4/1962 | Nolte | 206/430 |
| 3,339,725 | 9/1967 | Hamilton | 206/65 |
| 3,386,569 | 6/1968 | Gentry | 206/430 |
| 3,861,530 | 1/1975 | Calvert | 206/499 |
| 3,954,178 | 5/1976 | Mason, Jr. | 206/508 |
| 3,958,748 | 5/1976 | Smith et al. | 229/208 |
| 4,260,100 | 4/1981 | Hoffman | 229/109 |
| 4,319,680 | 3/1982 | Hiemstra | 206/499 |
| 4,744,464 | 5/1988 | Noe | 206/499 |

FOREIGN PATENT DOCUMENTS

| | | |
|---|---|---|
| 2174322 | 10/1973 | France . |
| 2225774 | 6/1990 | United Kingdom . |

*Primary Examiner*—Jimmy G. Foster

*Attorney, Agent, or Firm*—Fitch, Even, Tabin & Flannery

[57] ABSTRACT

The present invention provides a low cost paperboard sleeve package for holding tubs in a stacked manner. The sleeve has an octagonal configuration to provide stacking strength and space efficiency. The top of the sleeve is provided with an openable retainer to allow removal of the tubs. The bottom of the sleeve has retaining flaps which extend upward and inward to engage the lid and upper portion of the lowermost tub and which permit the stack of tubs to be loaded into the sleeve from the bottom. This supporting engagement enables the lowermost tub to support the weight of the tubs stacked above.

23 Claims, 2 Drawing Sheets

SLEEVE PACKAGE WITH SUPPORTING ENGAGEMENT

FIELD OF THE INVENTION

The present invention is directed to providing a carton or package for holding a stack of articles. More particularly, the present invention is directed to a low cost sleeve package for holding articles in a stacked manner.

BACKGROUND OF THE INVENTION

Despite the increasingly widespread use of non-traditional packaging materials, paperboard containers and cartons are oftentimes the most cost effective and easiest to fill and transport. A desire for an efficient durable carton has caused the cost to increase in order to meet the requisite strength and durability necessary to support the weight of the contents. Many times, these costs are attributable to the materials necessary to manufacture the desired carton and the labor necessary to fill, seal and transport the carton. Also, these traditional paperboard cartons generally do not provide for adequate inspection of the contents and are damaged when opened for inspection, and since these cartons usually are not resealable for storing and transporting the original contents, a different or new carton is required to store or transport the contents. The purpose of this invention is to provide an efficient, effective and durable carton solving many of the following problems.

An object of the present carton is to provide a carton having the necessary strength to provide bottom and lateral support for the contents at a reduced cost. Many of the cartons used today completely enclose the articles within the carton on all sides requiring a large amount of material. Additionally, a large amount of material required for these cartons is used in the bottom to provide the required bottom support and in the walls to provide the requisite lateral support for the contents. Even though these cartons usually provide a safe and secure container for transporting articles, the problem is that the desired structural support is commonly achieved through the amount of material used in the design. For example, the heavier the contents the more material included in the design which usually increases the cost to the consumer. The more material used in heavier cartons increases the material and shipping costs. The present invention provides an efficient and effective carton which reduces the material necessary to support the contents and thereby reduces the overall weight of the carton.

Another object of this invention is to provide a carton which is easily loaded. The problem with many cartons is the cost of labor. The cartons must be filled and sealed which generally requires that the articles either be carefully positioned manually in the carton or inserted by a special and expensive automated packaging machine, and next, the carton must be carefully and securely sealed. The careful positioning of the articles and the careful sealing process commonly becomes very labor intensive. Thus, in packaging operations, it is important to reduce the labor cost which in turn reduces the cost to the consumer. Therefore, the object of the present invention is to reduce the time necessary for filling and sealing the carton through a carton design which reduces the labor associated with loading and closing the carton.

A further object of the present container is to provide a carton in which the contents can be inspected. With the traditional cartons usually enclosing the contents completely on all sides to provide the requisite support, inspection of the contents is difficult without opening the carton. Once the carton is opened, it is generally rendered unsuitable for further use. Consumers commonly want to inspect the contents of cartons or containers for defects or content identification, and the carton usually is torn open or damaged to conduct this inspection. For all practical purposes, the carton is rendered unsuitable to be used again for storage or transportation. This practice of opening and damaging the carton to inspect the contents is undesirable, and when the carton is sealed for a one time opening, it is especially undesirable because it probably requires destruction of the carton. Thus, it is desired to provide a carton where the contents are inspected without damaging the carton or the contents.

A further object of this invention is to provide a carton which permits the contents to be subject to non-damaging inspection without sacrificing the requisite durability and strength. The problem with traditional cartons is either that the strength and durability of the carton is reduced in order to provide windows or that a less durable and content protecting transparent packaging is used. For example, articles may be wrapped tightly in transparent sheets of plastic packaging. This packaging provides a package with the desired inspection capability of the contents; however, this plastic packaging generally does not provide any protection for the contents during shipping. Also, once the seal or the transparent plastic is opened to get at the contents, the packaging usually is not reusable to store or transport the articles. Additionally, these plastic packaging alternatives leave non-biodegradable waste which is contrary to environmental concerns. Thus, it is desired to provide a packaging carton enabling inspection which continues to protect the contents against damage and is reusable for storage and transportation and which is safe for the environment.

Another object is to provide a carton which can display information disclosing the contents. Identification of the contents is important to any one inspecting the carton and its contents. Many times, cartons contain a variety of articles having different features, and it is preferred to provide information describing the contents on the carton by copy printed on the carton sidewall or on a label. The content's description is an important supplement to providing a container in which the contents are capable of being inspected. This feature further reduces the necessity of having to open the container to determine the contents.

It is an overall object of the present invention to provide a new, efficient, effective and durable container which can be easily and quickly loaded with articles. A further object is to permit all the articles to be easily and quickly inspected. Another object is to provide a container having a surface on which a description of the contents may be displayed. A final objective is to provide a container having the above discussed feature and advantages which may manufactured at a minimum cost.

These and other objects will become apparent from the following description and the appended claims.

SUMMARY OF THE INVENTION

In accordance with the present invention, a new and improved packaging carton is provided in which articles are held stacked in a reusable sleeve like carton. The sleeve facilitates easy removal and replacement of the articles from a top end of the carton. To accommodate this removal and replacement, the sleeve has a top end which can be opened to allow the articles to be removed and replaced back in the sleeve. Bottom retaining flaps support the weight of the stack and prevent removal of a lowermost article downwardly through the bottom end of the carton. These retaining flaps engage the lowermost article and lock this article in the sleeve. This lowermost article acts as a bottom to the sleeve and holds the above stack of articles securely in the sleeve. The articles are loaded in the sleeve by forcing the articles into the sleeve while deflecting the retaining flaps. In addition to the top end, the articles also can be replaced back in the sleeve through the bottom end as described in the above loading procedure.

The sleeve wall provides lateral support needed to hold the articles in their stacked position. In order to see the contents, certain of the sleeve's wall sections have windows which expose the articles for inspection. Advertising or information describing the enclosed articles may be imprinted or placed on labels on the sleeve's wall sections.

Preferably, the sleeve is constructed from a unitary paperboard blank having fold lines to form a plurality of adjacent wall sections. When assembled, the wall sections form the sleeve having a top open end for removing 5 articles and a bottom open end having retaining flaps Articles are inserted into the sleeve through the lower end of the sleeve past the retaining flaps which will engage and hold the lowermost article in the stack against falling from the sleeve. Specifically, each flap is angularly disposed with respect to the wall of the sleeve so as to positively engage a lip and a side surface at the upper end of the lowermost article. These flaps are of predetermined length and positioned at a predetermined angle so as to engage the lip and side surface depending on the size and diameter of the article.

At the top open end of the carton, a retainer, preferably in the form of a band, spans the upper open end of the package to prevent the removal of articles from the top. The band is separable along the length thereof to facilitate removal of articles from the sleeve. The separation of the band is easily done without destroying the sleeve so the articles may be replaced back in the sleeve after their removal. The band, for example, is easily separated either by tearing it by hand or by cutting it with a tool, such as a knife or scissor. If desired, the band may be designed to be resealable.

The sleeve is easily loaded with the stacked articles. The unitary paperboard blank is either preassembled where the sleeve is already constructed, or if desired, the sleeve is easily constructed as needed. If the sleeve is unassembled, the blank is folded, and a pair of wall sections with free ends are secured together to form the sleeve. Then, the flaps on the bottom of the sleeve are folded at least slightly inward. Preferably, the flaps are folded inward to a position perpendicular to the wall sections; however, this pre-folding stage is not required. Next, the articles are loaded in the sleeve so as to engage the flaps and deflect them to their angularly disposed position. In an alternative loading method, the sleeve is lowered down upon a stack of articles. Continuing to lower the sleeve causes the flaps to deflect and slide against the article while pivoting upward in the sleeve to their angular disposed position. When the sleeve completely encloses the stack of articles, the flaps engage the upper area of the lowermost article. Specifically, the flaps engage the lowermost article under the lid to form a supporting engagement. This supporting engagement locks and holds the lowermost article in the sleeve which in turn supports the articles resting on the lowermost article.

Finally, the preferred top, retainer band, is formed from a pair of diametrically opposing band forming flaps. These band forming flaps are secured together to form this top band. These flaps are easily secured together with an adhesive, such as a nontoxic glue.

The sleeve additionally provides support in the vertical or longitudinal direction enabling many assembled sleeve's to be stacked one upon another for packaging in larger shipping containers. The sleeve's structural support in the longitudinal direction also reduces damage to the articles caused from the weight of other loaded sleeves stacked on top of it. Further, the shipping of an individual or many unassembled packaging sleeves is efficient because the unitary paperboard blank can lay flat, and as a result, many blanks are packaged in a small container for shipping or storage. Again, the sleeves are easily assembled on location for loading.

The present invention provides the desired low-cost packaging carton because of the reduction in requisite material necessary to provide support for the contents. The carton also reduces the labor cost because the design employs a carton which can be filled and sealed in less time than the traditional paperboard cartons. As a result of the material required and the design employed, these advantages provide an efficient, effective packaging carton while reducing the packing and shipping costs.

BRIEF DESCRIPTION OF THE DRAWINGS

The present invention will be described in connection with the accompanying drawings, which illustrate the preferred embodiment and details of the invention, and in which.

DETAILED DESCRIPTION OF THE PREFERRED EMBODIMENT

Figure 1:
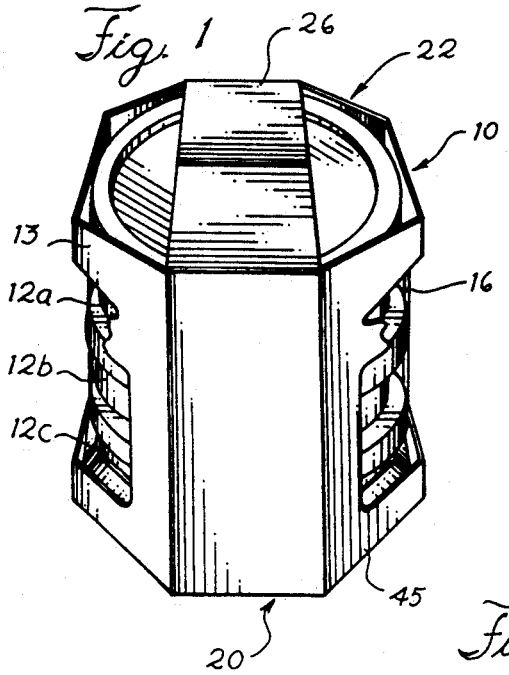
FIG. 1 is a perspective view of a sleeve package with supporting engagement embodying the present invention.

It is common to transport and store a variety of articles in a low-cost package or carton in Which the articles are visible to inspect. A package 10, as shown in FIG. 1, embodies the present invention and is used in packaging to store and transport articles 12a, 12b and 12c in a stacked manner. The articles 12a, 12b and 12c are stacked one on top of another and are enclosed entirely within the package. More particularly, a package 10 consists of a sleeve 14 which surrounds the stacked articles and which includes a lower open end 20 through which articles are inserted, and a closed upper end 22 from which the articles may be removed from the sleeve.

Figure 2:
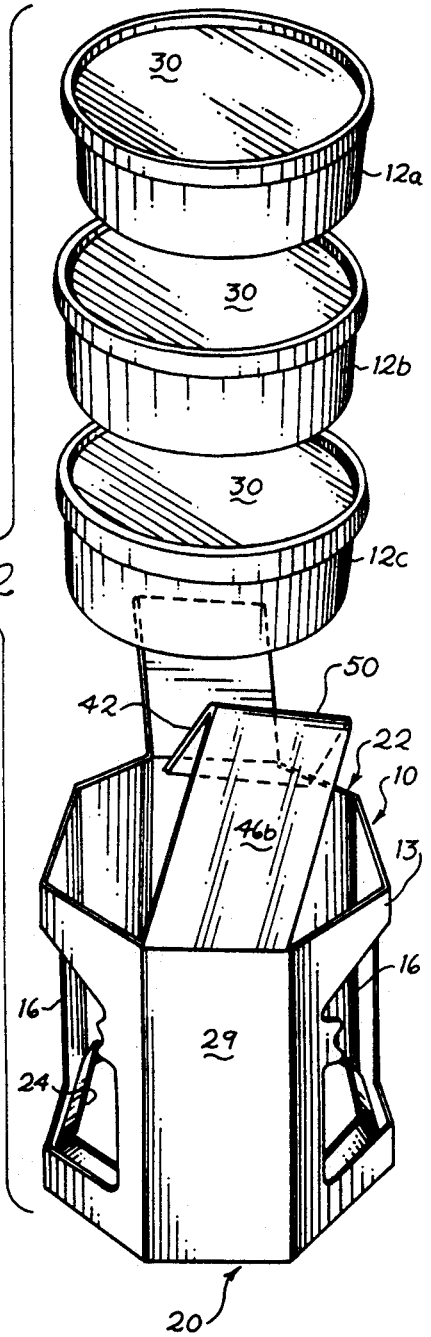
FIG. 2 is an exploded perspective view of the sleeve package depicting a stack of articles being removed from the package.
Figure 4:
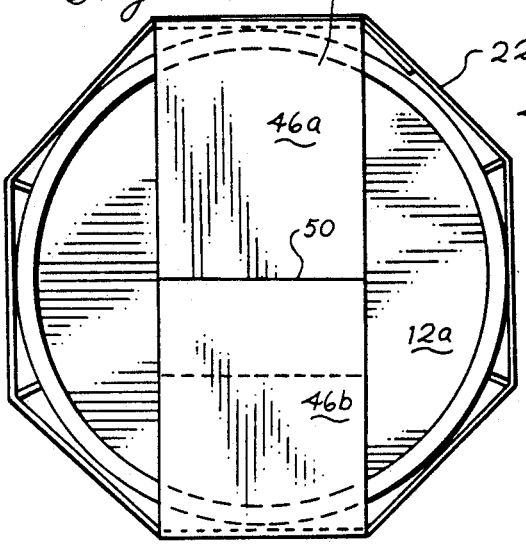
FIG. 4 is a top plan view of the package of FIG. 1.
Figure 5:
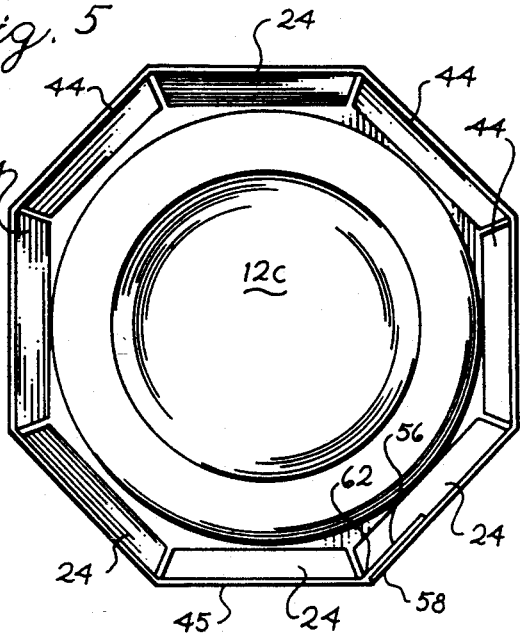
FIG. 5 is a bottom plan view of the package of FIG. 1.
Figure 6:
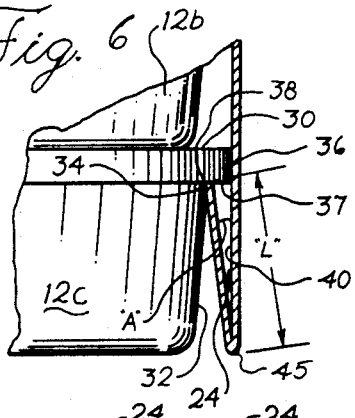
FIG. 6 is an enlarged fragmentary sectional view of the sleeve package taken along the line 6—6 of FIG. 3.

As best seen in FIGS. and 3, the preferred embodiment of package 10 is shown enclosing three articles 12a, 12b and 12c in a stacked manner, the stack of articles being referred to collectively by reference number 12. However, any number of articles may be used depending on the length of the sleeve and size of the articles. An upright wall 13 forms the sleeve 14 with the lower open end 20 through which the articles 12 are inserted into the sleeve 14 and the closed upper end 22 from which the articles 12 may be removed from the sleeve. About the lower end 20, retaining flaps 24 are integrally connected to the sleeve 14, as best seen in FIGS. 5 and 6. These flaps 24 extend inwardly and upwardly from the sleeve 14 to engage or abut the lowermost article 12c. This engagement prevents the lowermost article 12c from falling from the sleeve 14. As a result, flaps 24 retain the stack of articles 12 within the sleeve 14 since the lowermost article 12c supports the entire stack of articles 12. At the closed upper end 22, a retainer 26 is integrally connected to the sleeve 14 and extends across the upper end 22 of the sleeve to abut an uppermost article 12a, as best shown in FIGS. 1 and 4. This retainer 26 prevents the removal of the articles 12 from the sleeve 14 until the retainer 26 is rendered ineffective, as shown in FIG. 2.

Figure 3:
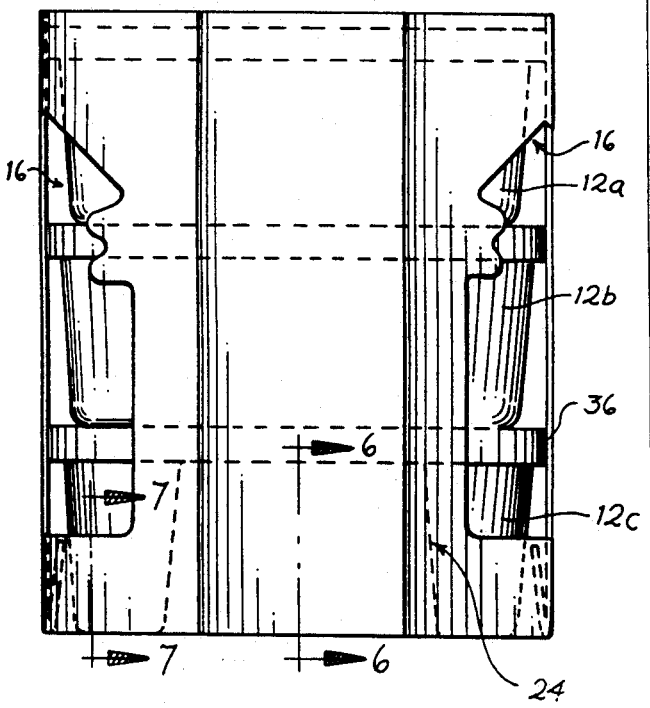
FIG. 3 is an elevational view of the sleeve package of FIG. 1.
Figure 8:
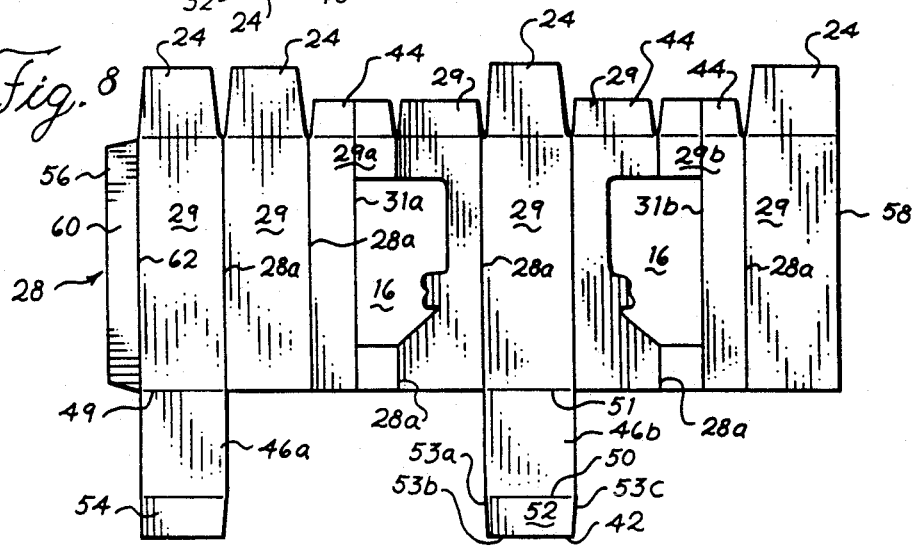
FIG. 8 is a plan view of a carton blank from which the sleeve package of FIGS. 1-7 is assembled.

The sleeve wall 13 provides lateral support to maintain the articles 12 in their stacked arrangement and vertical or longitudinal support enabling packages of this invention to be stacked one upon another while minimizing the possibility of the articles shifting. Referring to FIG. 8, the sleeve 14 is constructed from a unitary paperboard blank 28. The blank 28 has fold lines 28a to form a plurality of adjacent wall sections 29 forming the sleeve wall 13. When assembled, these wall sections 29 form the sleeve 14 which encloses the articles 12. In order to permit viewing of the articles 12 inside the package, certain of the sleeve's wall sections have windows 16, as shown in FIGS. 1 and 3. These windows 16 expose the articles for inspection. Inspection is necessary to determine the contents of the carton and to look for any product defects. The retaining flaps 24 and the flaps forming the retainer 26 are shown integrally attached to the blank 28 and are described in more detail below.

Referring now to FIGS. 3–7 for a more detailed description of the preferred embodiment, the articles 12 are inserted into the sleeve 14 through the lower open end 20 of the package. The articles 12a, 12b and 12c are cup shaped receptacles having lids for top end closures and are typically used in connection with the merchandising of butter, margarine, cheese and other food spreads. The stack of articles or receptacles may alternatively be referred to as tubs 12. In order to place the articles or tubs 12 into the sleeve 14, the tubs 12 are forced up into the sleeve 14 deflecting the retaining flaps 24. Each of the tubs 12 has a lid 30 or lip which initially engages flaps 24. As each of the tubs 12 is continued to be inserted, the flaps 24 are deflected by the lid 30 and an outer surface 32 of each of the tubs 12 until the entire tub is received within the sleeve 14. Tubs 12 are inserted into the sleeve until the lowermost tub 12c is inserted into the sleeve 14. When the flaps 24 slide past the lid 30 of this lowermost tub 12c, the tub 12c is completely received within the sleeve 14. The lowermost tub 12c deflects the flaps 24, which abut and engage lid 30 and the outer surface 32 of the lowermost tub 12c. As so engaged, the flaps 24 are angled inwardly with respect to the walls 40 of the sleeve 14 so as to positively engage the lowermost tub 12c, to form a supporting engagement. Moreover, these retaining flaps 24 are of predetermined length and positioned at a predetermined angle so as to extend a predetermined distance depending on a diameter of the tub in order to provide the requisite engagement to support the entire stack of tubs.

Referring specifically to FIG. 6 for a more detailed showing of the supporting engagement, each retaining flap 24 abuts the lid 30 of the lowermost tub 12c at an underneath position 34. The lid 30 has a depending flange 36 extending down below the upper surface of lid 30 and overlying the upper edge of the outer surface wall 32 of the tub 12c. The flange 36 is formed with a downwardly facing edge or surface 37. Alternatively, the tub may have a portion at the upper end formed with a lip running the perimeter providing a downwardly facing annular shoulder or ledge like surface to combine with the flange 36 of the lid 30 to form a more continuous ledge like surface for engagement by the flaps 24. As is evident from FIG. 6, each flap 24 engages the downwardly facing edge 37 and the wall 32 of the tub 12 at a corner or line 38 to fixedly position the flap 24 in the supporting engagement, whereby, the lowermost tub 12c is unable to fall through the bottom end 20 of the sleeve 14. This supporting engagement prevents removal of tubs 12 because the flaps 24 are seated at a predetermined angle "A" from the sleeve wall 32. By maintaining the angle "A" small, the load applied by the stack of tubs 12 is applied lengthwise to the flaps 24 and generally lengthwise of the sleeve 14, as opposed to perpendicular to the bottom in cartons employing a traditional flat surface bottom. The flaps 24 and the sleeve 14 are capable of withstanding much higher forces in this lengthwise direction than would be possible with lateral loads. This type of force distribution enables the weight to be handled by less material. Additionally, a predetermined length "L" for the flap is required in order to extend from the sleeve wall 14 at a pivot point to the corner 38. The tub's diameter and height determines the requisite angle "A" and the necessary length "L" for flaps 24. For example, the smaller the diameter of the tub the longer the length of the flap because a larger angle between the flap and the sleeve wall is required.

Figure 7:
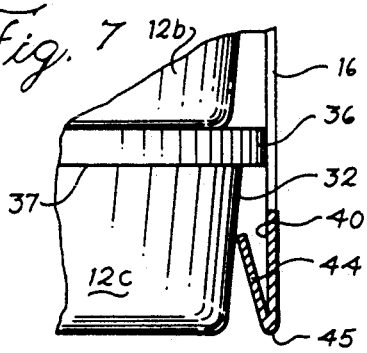
FIG. 7 is an enlarged fragmentary sectional view of the sleeve package taken along the line 7—7 of FIG. 3.

As seen in FIGS. 5 and 8, flaps 44, which extend from the sleeve wall directly below either of the windows 16, are shorter in length than the retaining flaps 24 so as to avoid obstruction of the windows 16. As best shown in FIG. 7, the shorter flaps 44 do not engage the flange 36 or the lid 30 and the outer surface 32 of the lowermost tub at a line or corner 38, like the retaining flaps 24 of FIG. 6. However, flaps 44 abut the outer surface 32 of the lowermost tub 12c at an angularly disposed position with respect to the wall 40 of the sleeve 14. The flaps 44 abut the tub 12c in this manner so that the flaps are maintained inside the sleeve 14. Additionally, these flaps 44 provide support and rigidity for bottom edge 45 of the package 10 and prevent the bottom end of the sleeve from becoming torn or damaged.

It should be understood that the portions of the sleeve wall 13 between the openings 16 will be imprinted with copy identifying and describing the articles contained in the package 10. Alternatively, labels bearing such copy may be applied to the wall sections 29.

Referring now to FIGS. 4 and 8 for a more detailed description of the retainer 26 at the closed upper end 22, the preferred retainer 26 is formed from a pair of diametrically opposed flaps 46*a*, 46*b* having overlapping end portions joined together at the center of the sleeve 14. Flaps 46*a* and 46*b* are integrally connected to the sleeve 14 and, in the assembled position of the package 10, extend across the upper end 22 of the sleeve perpendicular to wall sections 29 forming the retainer 26.

Referring specifically to FIG. 8 for a detailed description of the retainer, the flap 46*b* of the retainer 26 has a perforated score line 50 at which retainer 26 can easily be severed. In addition to being easily severed, the perforated score line 50 enables the outer end of flap 46*b* comprising a tab or flap 42 to easily be folded 180 degrees to lay flush with the remaining unfolded portion of the flap 46*b*. An adhesive, such as a non-toxic glue, is then applied to a surface 52 of flap 42 which is defined by score line 50 and edges 53*a*, 53*b* and 53*c*. After the adhesive is applied, flap 46*a* and flap 46*b* are pivoted about score lines 49 and 51, respectively, which enable flaps 46*a* and 46*b* to rotate inward toward the center of the sleeve, until surface 52 of flap 46*b* is mated with surface 54 of flap 46*a* to form the retainer 26. Alternatively, the adhesive may be applied after the flaps 46*a* and 46*b* are positioned toward the center of the sleeve.

Referring again to FIG. 8, the sleeve 14 is easily shipped to a location for packaging. Many unassembled packaging sleeves are capable of laying flat, and as a result, many blanks are packaged in a small container for shipping or storage. The unitary paperboard blank 28 is easily assembled when the sleeve 14 is needed for packaging. The sleeve 14 is assembled by folding the blank 28 along fold lines 28*a* in a constant direction so as to form a sleeve with a cross-section of polygonal shape. The cross-section polygonal shape increases the strength and structural integrity of the package. The polygonal shape provides a space saving configuration for generally cylindrical packages in that, when packages are placed next to each other in a larger container, more surface area of each package comes in contact as opposed to a cylindrical package. A sealing flap 56 is provided to mate with an opposite end edge 58. An adhesive or alternative sealing material is applied to either surface 60 of the sealing flap 56. Surface 60 is then mated with a wall section defined by edge 58 in a manner where a fold line 62, defining the sealing flap 56, is matched up parallel and near to edge 58 as seen in FIG. 5.

The package 10 is adapted to be shipped to a packaging location in the disassembled condition as described above or in a preassembled and flattened condition as described below. For transporting preassembled sleeves, the blank 28 is folded and sealed along flap 56, and the sleeve 14 is folded symmetrically flat about a pair of score lines 31*a* and 31*b* which also boarder windows 16, as shown in FIG. 8. During this symmetrical folding, the flaps 46*a* and 46*b* are folded in toward the center of the sleeve about score lines 49 and 51 until they are flush, and at the same time, flap 42 pivots 180 degrees about the perforated score line 50 and the flaps 46*a* and 46*b* are sealed as described above. When the sleeve 14 is needed for filling, the sleeve is folded to its octagonal shape having 8 planar wall sections. In order to permit the package 10 with the flaps 46*a* and 46*b* sealed together to be folded flat, a pair of wall sections 29*a* and 29*b* are formed to contain the fold lines 31*a* and 31*b* which are equidistant from retainer 26. While these fold lines 31*a* and 31*b* have a slight tendency to prevent the wall sections 29*a* and 29*b* from being completely planar, the flaps 44 at the bottom of the panels 29*a* and 29*b* tend to maintain the planar form when folded inwardly. This folding of sleeve 14 to the octagonal shape rotates flaps 46*a* and 46*b* upward from the center of the sleeve, to the position described earlier to form the retainer 26.

As can further be seen in FIG. 4, the retainer 26 extends from a pair of diametrically opposed walls and spans the upper closed end 22. The retainer 26 abuts the lid or upper end of the uppermost tub 12*a*. The retainer 26, through this engagement, effectively closes the upper end 22 and maintains the stack of tubs 12 within the sleeve. The retainer alternatively may be designed to be re-sealable. The flaps 46*a* and 46*b* may be secured together in a manner where they are not sealed for a one time opening.

If the flaps 46*a* and 46*b* are not resealable, the retainer 26 is opened along the perforated score line 50 permitting easy removal of the tubs 12. Any number of methods however may be used to severe the retainer and open the package. Once the retainer is rendered ineffective, the tubs 12 are removed from the sleeve 14. The tubs 12 can easily be replaced back in the sleeve for storage.

In order to load the sleeve, the tubs 12 are inserted into the sleeve from the bottom end so as to engage the flaps and deflect them to their angular disposed position as described previously. It is preferred that the retaining flaps 24 are folded inwardly to a position which insures that the flaps during loading will all pivot inwardly, but this step is not necessary. In an alternative loading method, the sleeve is lowered down upon a stack of tubs. Continuing to lower the sleeve causes the flaps to slide or cam against the stack of tubs while pivoting inwardly in the sleeve to their angular disposed positions. When the sleeve completely encloses the stack of tubs, the flaps engage a top portion of the lowermost article and form the above described supporting engagement in the container which in turn supports the above stack of tubs.

When the sleeve is loaded, the preferred retainer, formed from a pair of diametrically opposing flaps, is sealed as described. These flaps should be sealed with a safe adhesive, such as a nontoxic glue. The flaps forming the retainer may be sealed prior to loading the tubs or at the same time the side wall seal is accomplished.

While the preferred embodiment has been shown and described, it will be understood that there is no intent to limit the invention by such disclosure; but rather it is intended to cover all modifications and alternative constructions falling within the spirit and the scope of the appended claims.

We claim:

1. A package for holding a plurality of articles in a stack, the stack comprising at least a lowermost article and a topmost article, each of the articles comprising an upper portion, the package comprising:

an upright wall forming a sleeve surrounding the stacked articles and extending vertically of the entire stack of articles and restraining said articles from lateral displacement, the sleeve having a lower open end through which the articles are inserted into the sleeve, an upper end and at least one window extending vertically of the sleeve to make each of the articles partially visible;

a plurality of first flaps integrally connected to the lower end of the sleeve and extending inwardly and upwardly to abut the upper portion of the lowermost article to lock the lowermost article from displacement through the lower open end of the sleeve, the flaps being deflected by the article being inserted through the lower open end of the sleeve;

a plurality of second flaps being shorter than the first flaps and integrally connected to the lower end of the sleeve adjacent the at least one window and extending inwardly and upwardly to abut the lowermost article; and a retainer integrally connected to the sleeve and extending across the upper end of the sleeve to engage the topmost article of the stack to prevent removal of the articles from the sleeve.

2. A package in accordance with claim 1 in which the retainer comprises retainer flaps which extend from the sleeve wall, the retainer flaps being joined to each other within the upper end of the sleeve.

3. A package in accordance with claim 1 in which the sleeve is made of paperboard having a plurality of vertically extending fold lines in the wall forming a plurality of adjacent panels and a polygonal cross-sectional shape for the sleeve and a transverse fold line across the retainer, the fold lines enabling the package to be maintained in a folded flat configuration prior to use and subsequently shifted to an open configuration for receiving the articles by pivoting the panels and retainer about the fold lines.

4. A package in accordance with claim 3 in which the flaps on the lower end of the sleeve are pivotally connected to lower ends of the panels.

5. A package in accordance with claim 4 in which the retainer comprises a pair of retainer flaps pivotally and integrally joined to upper edges of two of the panels, the retainer flaps having overlapping center portions joined together.

6. A package in accordance with claim 3 in which the sleeve has a plurality of horizontal score lines about which the flaps pivot inward and upward, each score line extending across one of the plurality of adjacent panels of the sleeve at a common position with respect to the lower end.

7. A package in accordance with claim 1 in which the sleeve has a pair of vertically extending fold lines in the wall, the vertical extending fold lines positioned equidistant from the retainer for folding the sleeve symmetrically about the retainer.

8. A package in accordance with claim 1 in which the lowermost article has a predetermined cross-sectional diameter as viewed in plan and each of the plurality of first flaps includes a predetermined length and a predetermined disposed angle with respect to the sleeve, the length and angle increasing as the predetermined cross-sectional diameter of the lowermost article decreases.

9. A package for holding a plurality of articles stacked vertically one on top of another comprising:

a plurality of adjacent walls forming an enclosure engaging the articles and restraining the articles against lateral displacement, the enclosure defining a first open end and a second open end;

a plurality of flaps each extending from one of the walls at the first open end inward and upward to engage and hold the article in the enclosure adjacent the first open end from displacement from the first open end; and a retainer extending from at least one pair of the walls spanning the second open end to retain articles within the enclosure;

at least one of said walls having an opening therein exposing the articles for inspection, said opening having a lower edge at a predetermined elevation, at least one of said flaps having an upper edge disposed at an elevation above that of said lower edge of said opening, and being positioned to avoid obstruction of said opening.

10. A package in accordance with claim 9 wherein the enclosure is formed from an unitary paperboard blank.

11. A package in accordance with claim 9 wherein the article adjacent the first open end is generally cylindrical in shape and includes a top and a bottom and a downwardly facing annular shoulder adjacent the top, the flaps extend inwardly and upwardly at an acute angle to the walls to engage the article adjacent the first open end at the annular shoulder to lock it against movement out of the first open end.

12. A package in accordance with claim 9 wherein the retainer is formed from at least two retainer flaps which extend from parallel opposed walls and are secured together.

13. A package in accordance with claim 12 wherein the retainer flaps are secured together with an adhesive.

14. A package in accordance with claim 13 wherein the retainer flaps are secured together so as to be reusable after being opened to remove the articles.

15. A package in accordance with claim 9 wherein the walls are provided with openings to inspect the articles.

16. A package for enclosing a generally cylindrical article comprising:

a sleeve having a continuous wall which surrounds vertically the entire article and engages the article securing the article against lateral displacement, the wall comprising at least one window for inspecting the article, the sleeve having a first open end and a second open end, the first open end being provided with a plurality of integrally formed inwardly extending lock flaps and at least one article engaging flap, the flaps each having a free end and a pivot end, the flaps each having a pivot line and being deflectable inwardly and upwardly about the pivot line to a position against the wall during insertion of the article into the sleeve and being resiliently biased to return to an angled position with respect to the wall, each pivot line being located at the first open end, the at least one article engaging flap being located adjacent the at least one window and being of lesser length than the lock flaps, the article having a peripherally disposed downwardly facing annular shoulder engaged by the free ends of the lock flaps in the angled position to lock the article from movement outwardly through the first open end, the article being engaged by the free end of the at least one article engaging flap, and retaining means connected to the walls and extending across the second open end to prevent displacement of the article through the second open end.

17. A package in accordance with claim 16 wherein the sleeve is formed of paperboard which is folded to provide a plurality of adjacent wall panels having an octagonal cross-sectional shape, the flaps and the retaining means and the wall panels being formed integrally from a single blank.

18. A package in accordance with claim 16 wherein the sleeve is formed of paperboard which is folded to provide a plurality of adjacent wall panels each angled with respect to the adjacent wall panels, the sleeve being foldable to a flat configuration which is symmetrical about the retaining means.

19. A package in accordance with claim 16 wherein the article comprises a plurality of cup shaped containers stacked one on top of another, each of the containers being formed with the downwardly facing annular shoulder, the lock flaps engaging the downwardly facing annular shoulder on the container located adjacent the first end to hole the stacked containers against the retainer means and secured against displacement lengthwise of the sleeve.

20. A method of packaging a plurality of stacked articles in a sleeve package, the stacked articles having an uppermost article and a lowermost article, the sleeve package having a first top end from which to remove the articles, a retainer across the top end to prevent removal of the uppermost article until the retainer is released, a plurality of vertically extending fold lines forming a plurality of adjacent panels and a transverse fold lines enabling the sleeve package to be folded flat, and a second lower end having first flaps for locking engagement with the lowermost article and shorter second flaps for abutting engagement with the lowermost article, said method comprising the steps of:

providing the sleeve package for packaging the stacked article, the sleeve package being in a folded flat configuration about the horizontal and vertical fold lines;

unfolding the sleeve package for receiving the stacked articles from the folded flat configuration by pivoting the adjacent panels about the vertical fold lines to give the sleeve package a polygonal cross-sectional shape and pivoting the retainer about the transverse line to form the retainer across the top end;

loading the articles into the sleeve package at the lower end;

locking the lowermost article against removal from the second lower end of the sleeve package by deflecting the first flaps to a first angled position in which the first flaps are directed inwardly and upwardly to abut and support the weight of the articles; and deflecting the second flaps inward and upward to a second angled position different than the first angled position to abut the lowermost article.

21. A method in accordance with claim 20 where the retainer across the top end is formed by attaching together a pair of retainer flaps which are diametrically opposed.

22. A method in accordance with claim 21 wherein the pair of retainer flaps are glued together.

23. A method in accordance with claim 20 wherein the each article has a flange about its perimeter at one of its ends and the flaps at the second lower end have free ends abutting against a lower side of the flange to support the stack of articles in the sleeve.

* * * * *

UNITED STATES PATENT AND TRADEMARK OFFICE

CERTIFICATE OF CORRECTION

PATENT NO. : 5,244,093

DATED : September 14, 1993

INVENTOR(S) : Gary H. Carmichael and Harry I. Roccaforte

It is certified that error appears in the above-indentified patent and that said Letters Patent is hereby corrected as shown below:

Column 4, line 66, change "Which" to --which--.

Column 5, line 10, after "FIGS." insert --1--.

Column 11, line 24, change "hole" to --hold--.

Column 11, line 35, after "fold" insert --line across the retainer, the vertical and transverse fold--.

Signed and Sealed this

Twelfth Day of April, 1994

*Attest:*

Bruce Lehman

BRUCE LEHMAN

*Attesting Officer*

*Commissioner of Patents and Trademarks*